US006734805B2

(12) United States Patent
Johnson

(10) Patent No.: US 6,734,805 B2
(45) Date of Patent: May 11, 2004

(54) COMPOSITE PIPE TELEMETRY CONDUIT

(75) Inventor: Ready J. Johnson, Houston, TX (US)

(73) Assignee: ABB Vetco Gray Inc., Houston, TX (US)

( * ) Notice: Subject to any disclaimer, the term of this patent is extended or adjusted under 35 U.S.C. 154(b) by 461 days.

(21) Appl. No.: 09/922,039

(22) Filed: Aug. 3, 2001

(65) Prior Publication Data

US 2002/0014340 A1 Feb. 7, 2002

Related U.S. Application Data

(60) Provisional application No. 60/223,493, filed on Aug. 7, 2000.

(51) Int. Cl.[7] ..... G01V 3/00

(52) U.S. Cl. ..... 340/854.4; 340/854.3; 138/123

(58) Field of Search ..... 340/854.4, 854.3; 138/123, 124, 127

(56) References Cited

U.S. PATENT DOCUMENTS

| | | | | | |
|---|---|---|---|---|---|
| 2,178,931 | A | * | 11/1939 | Crites | 439/191 |
| 2,379,800 | A | * | 7/1945 | Hare | 336/105 |
| 3,170,137 | A | * | 2/1965 | Brandt | 340/855.1 |
| 3,253,245 | A | * | 5/1966 | Brandt | 439/191 |
| 3,769,126 | A | * | 10/1973 | Kolek | 156/172 |
| 4,020,790 | A | * | 5/1977 | Hyodo et al. | 118/44 |
| 4,095,865 | A | * | 6/1978 | Denison et al. | 439/191 |
| 4,113,287 | A | * | 9/1978 | Bogatirev et al. | 285/124.4 |
| 4,195,906 | A | | 4/1980 | Dean et al. | 350/96.23 |
| 4,690,212 | A | * | 9/1987 | Termohlen | 166/65.1 |
| 4,914,433 | A | * | 4/1990 | Galle | 340/854.4 |
| 4,989,643 | A | * | 2/1991 | Walton et al. | 138/126 |
| 5,172,765 | A | | 12/1992 | Sas-Jaworsky et al. | 166/384 |
| 5,771,975 | A | | 6/1998 | Anderson et al. | 166/367 |
| 5,921,285 | A | * | 7/1999 | Quigley et al. | 138/125 |
| 6,004,639 | A | | 12/1999 | Quigley et al. | 428/36.3 |
| 2001/0032892 | A1 | * | 10/2001 | Brooks et al. | 239/450 |

* cited by examiner

*Primary Examiner*—Timothy Edwards
(74) *Attorney, Agent, or Firm*—Bracewell & Patterson, L.L.P.

(57) ABSTRACT

A section of pipe for well operations has a cylindrical fiber composite pipe body and a pair of metallic end fittings. The end fittings differ from each other in that they are provided with mating key features to ensure proper angular or rotational alignment between two abutting sections of pipe. Each pipe is also provided with an optical fiber for data transmission. A fiber optic coupling is located at each end of the optical fiber for sending and receiving data transmissions via optical signals. Multiple strings of pipe are abutted end to end to complete both mechanical and data interfaces. At the junction of each pair of adjacent pipes, the end fittings axially and rotationally align. The flanges of the end fittings are fastened together with bolts such that data transmission takes place between the optical fibers.

13 Claims, 2 Drawing Sheets

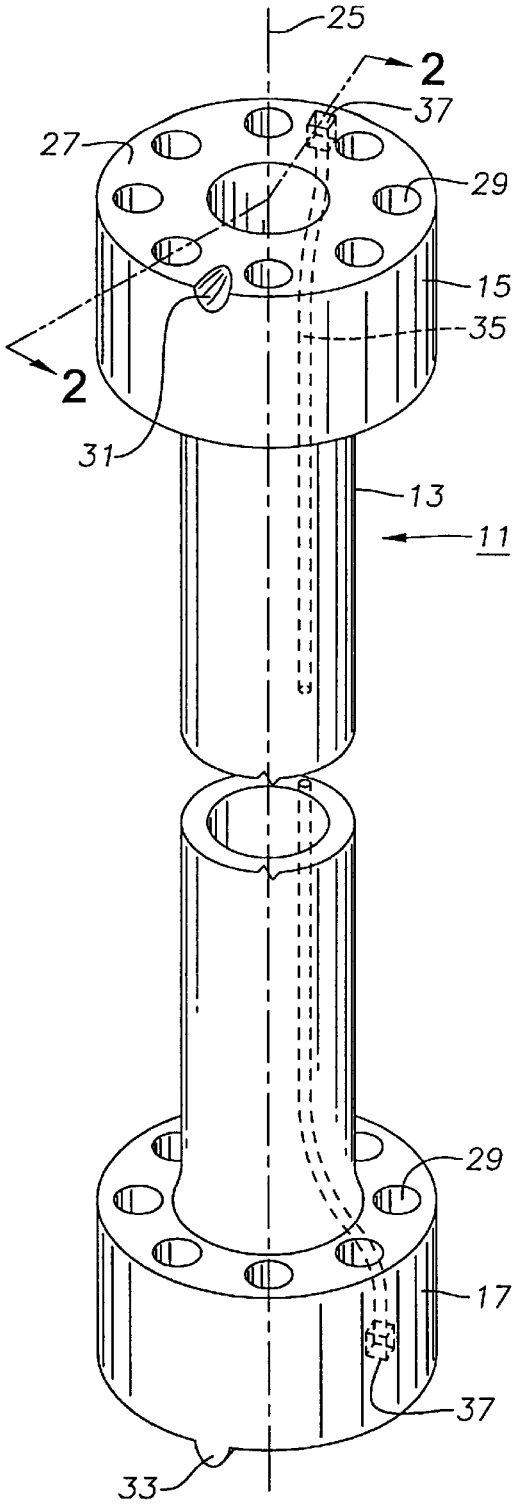
Fig. 1
Fig. 2
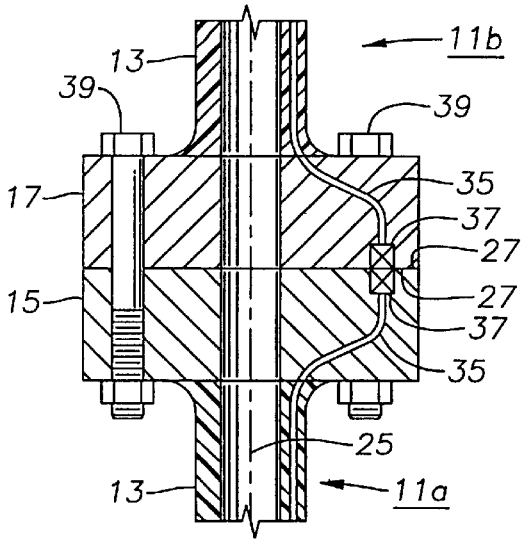
Fig. 3
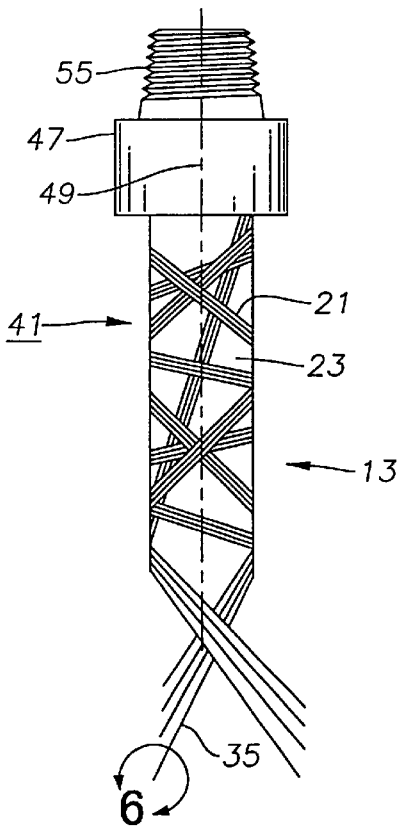

Fig. 4
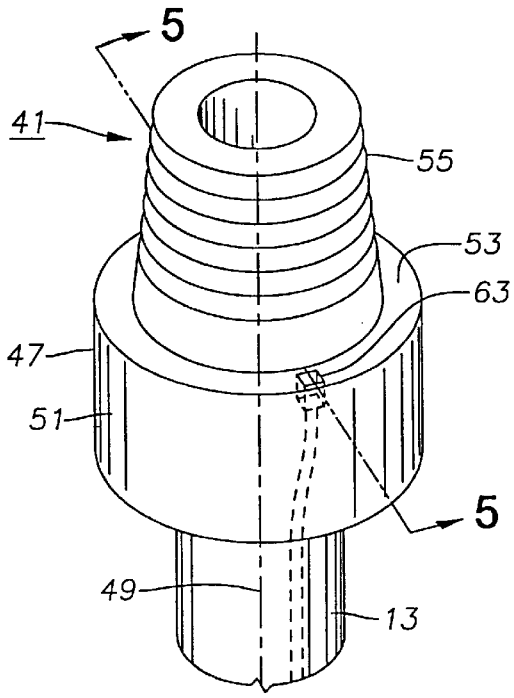
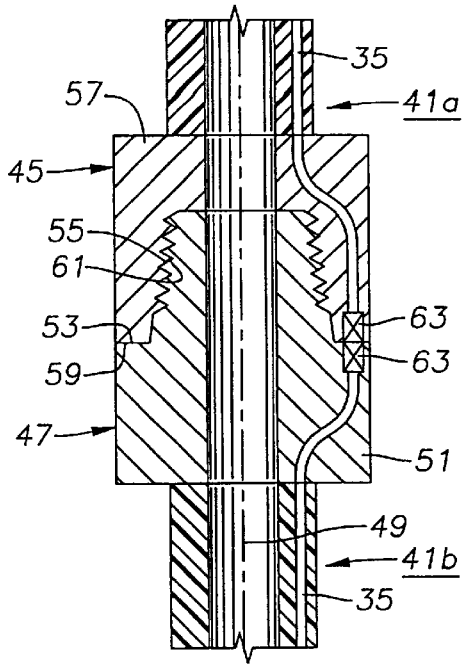
Fig. 5
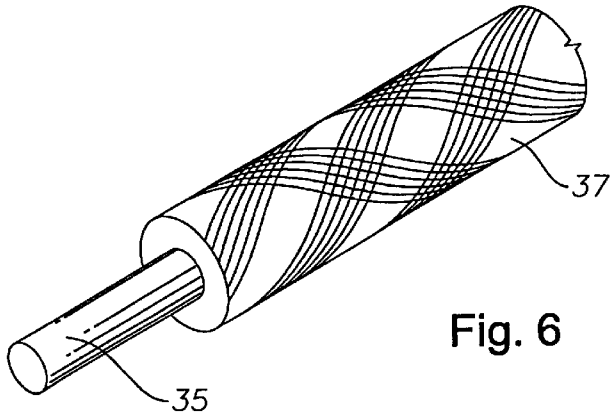
Fig. 6

COMPOSITE PIPE TELEMETRY CONDUIT

This application is claiming the priority date of provisional application Ser. No. 60/223,493, filed Aug. 7, 2000 entitled "Composite Pipe Telemetry Conduit."

1. Technical Field

The present invention relates in general to an improved composite pipe, and in particular to an improved communications mechanism for interconnecting composite pipes with metal end portions.

2. Description of the Prior Art

The use of composite materials in place of metal for various structures is desirable for many reasons, including weight reduction, corrosion resistance, durability, and increased strength. One type of structure that is useful in a variety of applications is a tube or cylinder. However, the tube must be joined to a structure of a dissimilar material at both of its axial ends to complete the terminations. Typically, a metallic end piece is used for this purpose, and may be joined to the composite via fasteners, adhesives, by the nature of end piece geometry, etc.

In some applications, such as riser pipes for downhole operations, it is desirable to transmit data from tooling located at the lower end of a string of such pipes. However, due to the extreme operating conditions in such applications, it can be difficult to maintain undistorted signals from the bottom of a well to the surface of the well. In particular, transmission of data signals must be effected throughout the length of the string of conduit and especially at the interfaces between the various sections of pipe. Thus, an improved apparatus and method of transmitting data signals in a string of pipe is needed.

SUMMARY OF THE INVENTION

One embodiment of a section of pipe for well operations has a cylindrical fiber composite pipe body and a pair of end fittings. The end fittings differ from each other in that they are provided with mating key features to ensure proper angular or rotational alignment between two abutting sections of pipe. Each pipe is also provided with an optical fiber for data transmission. The optical fiber extends along the entire length of pipe and through each end fitting. A fiber optic coupling is located at each end of the optical fiber for sending and receiving data transmissions via optical signals.

Multiple strings of pipe are abutted end to end to complete both mechanical and data interfaces. At the junction of each pair of adjacent pipes, the end fittings axially and rotationally align. The flanges of the end fittings are fastened together with bolts such that data transmission takes place between the optical fibers while a watertight mechanical seal is effected between the end fittings. Numerous strings of pipe are strung together for well operations, such as riser pipe applications, to effect both mechanical and data interfaces at each of the respective pipe junctions.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

FIG. 1 is an isometric view of a first embodiment of a section of flanged composite pipe constructed in accordance with the invention.

FIG. 2 is a sectional side view of opposite ends of two of the flanged composite pipe sections of FIG. 1 taken along the line 2—2 of FIG. 1 and shown abutting each other.

FIG. 3 is a side view of a second embodiment of a section of threaded composite pipe constructed in accordance with the invention, and shown with a composite portion thereof unraveled.

FIG. 4 is an enlarged isometric view of a male end of the threaded composite pipe of FIG. 3.

FIG. 5 is a sectional side view of opposite ends of two of the threaded composite pipe sections of FIG. 3 taken along the line 5—5 of FIG. 4 and shown abutting each other.

FIG. 6 is an enlarged isometric view of a sheathed optical fiber utilized in the pipe sections of FIGS. 1 and 3.

BEST MODE FOR CARRYING OUT THE INVENTION

Referring to FIG. 1, a first embodiment of a string or section of pipe 11 for well operations is shown. Pipe 11 is particularly well suited for use as riser pipe, and is formed from a combination of materials including a cylindrical fiber composite pipe body 13, and a pair of end fittings 15, 17, made of metal such as steel. Pipe body 13 is formed from a large number of wound fiber strands 21 (see FIG. 3), such as fiberglass or carbon fiber, that are embedded in a resinous matrix 23. The fibers 21 are cured in the matrix 23 to form the hardened, substantially inflexible pipe body 13. As schematically illustrated in FIG. 3, the strands of fiber 21 wind throughout the matrix 23 as they extend along the entire length of pipe body 13.

Pipe body 13 is rigidly joined to each of the metal end fittings 15, 17 in a manner such as those commonly known in the art. The longitudinal axes of pipe body 13 and end fittings 15, 17 coincide along the phantom line 25 such that their respective bores and through-holes also coincide. In the embodiment of FIGS. 1 and 2, each end fitting 15, 17 is essentially a flange having a flat face 27 and a plurality of bolt holes 29 that extend completely through their flange portions. However, end fittings 15, 17 differ from each other in that they are provided with mating key features. End fitting 15 has an integrally formed, female keyway 31, and end fitting 17 has an integrally formed or attached male key 33. Keyway 31 and key 33 ensure proper angular or rotational alignment between two abutting sections of pipe 11.

Each pipe 11 is also provided with an optical fiber or wire 35 for data transmission. Optical fiber 35 extends along the entire length of pipe 11 and is preferably employed as one of the fibers 21 in pipe body 13 (FIG. 3). As shown in FIG. 6, optical fiber 35 may located within a protective, insulating sheath 37 that provides mechanical strength for pipe 13. Optical fiber 35 also extends through or with each end fitting 15, 17 (shown schematically in FIGS. 1 and 2). A fiber optic connector or coupling 37, such as those commonly known in the art, is located at each end of the optical fiber 35. Couplings 37 are capable of sending and/or receiving data transmissions via optical signals. Alternatively, a partial or complete electrical signal transmission system maybe used in place of the optical system described above. In this alternative embodiment, optical fiber 35 may be replaced by an electrical conductor, and couplings 37 maybe replaced with electrical connectors and/or contacts. A hybrid system employing both electrical and optical components also may be substituted for these systems.

In operation, multiple strings of pipe 11 may be abutted end to end as shown in FIG. 2 to effect both mechanical and data interfaces. At the junction of each pair of adjacent pipes 11, the end fitting 15 of pipe 11*a* is aligned along axis 25 with the end fitting 17 of pipe 11*b* such that their faces 27 abut each other. The pipes 11*a*, 11*b* are rotationally positioned such that their respective couplings 37 and bolt holes 29 coincide. The flanges of end fittings 15, 17 are then fastened together with bolts 39 in a conventional manner. The alignment and close proximity of the couplings 37 allows data transmission to take place between their respective optical fibers 35 while a watertight mechanical seal is effected between the two end fittings 15, 17 using conventional elastomer or metal seal rings. Numerous strings of pipe 11 maybe strung together for well operations, such as riser pipe applications, to effect both mechanical and data interfaces at each of the respective pipe junctions.

Referring now to FIGS. 3–5, a second embodiment of the present invention is depicted as a string of pipe 41 for well operations. Like pipe 11, pipe 41 is formed from a combination of materials including a cylindrical fiber composite pipe body 13 and a pair of metallic end fittings 45, 47. Pipe body 13 is formed from a large number of wound fiber strands 21, such as fiberglass or carbon fiber, that are embedded in a resinous matrix 23. The fibers 21 are cured in the matrix 23 to form the hardened, substantially inflexible pipe body 13. As schematically illustrated in FIG. 3, the strands of fiber 21 wind throughout the matrix 23 as they extend along the entire length of the pipe body.

However, unlike pipe 11, the end fittings 45, 47 of pipe 41 are threaded instead of flanged. Pipe body 13 is rigidly joined to each of the metal end fittings 45, 47 such that the longitudinal axes and bores of pipe body 13 and end fittings 45, 47 coincide along centerline 49. In this second embodiment, end fitting 47 has a base 51 with a flat face 53 and a threaded male portion 55. End fitting 45 (FIG. 5) has a base 57 with a flat face 59 and an internal threaded female portion 61. These features of end fittings 45, 47 are provided for matingly engaging each other to ensure proper angular or rotational alignment between two abutting sections of pipe 41.

Also like pipe 11, each pipe 41 is provided with an optical fiber or wire 35 for data transmission. Optical fiber 35 extends along the entire length of pipe 41 and is preferably employed as one of the fibers 21 in pipe body 13 (FIG. 3). As shown in FIG. 6, optical fiber 35 is located within a protective, insulating sheath 37 that provides mechanical strength for pipe 13. Optical fiber 35 also extends through or with each end fitting 45, 47 with a fiber optic coupling 63 at each axial end. Couplings 63 provide the same features and performance as couplings 37, described above.

In operation, multiple strings of pipe 41 are abutted end to end as shown in FIG. 5 to effect both mechanical and data interfaces. At the junction of each pair of adjacent pipes 51, the end fitting 45 of pipe 41*a* is aligned along axis 49 with the end fitting 47 of pipe 41*b*. Portion 55 of pipe 41*b* is then threaded into portion 61 of pipe 41*a* until their faces 53, 59, respectively, abut each other. Pipes 41 are rotationally positioned such that their respective couplings 63 coincide. The alignment and close proximity of the couplings 63 allows data transmission to take place between their respective optical fibers 35 while a watertight mechanical seal is effected in a conventional manner. Numerous strings of pipe 41 may be strung together for well operations, such as riser pipe applications, to effect both mechanical and data interfaces at each of the respective pipe junctions.

The invention has several advantages. Incorporating a sheathed optic fiber or wire that is integrally woven in the composite of the pipe sections provides a more efficient conduit for transmitting data along the pipeline. The sheath provides the required local strength around the conduit in order to not compromise the overall integrity of the pipe. The optical transmission between pipe sections is accomplished at the end fittings. The end fitting may be tapered with threaded fasteners, or flanged and bolted together. Data transmission takes place through aligning lenses or electrical contacts. In either case, close rotational alignment of the optic fibers or electrical wires is assured through mechanical devices.

While the invention has been shown or described in only some of its forms, it should be apparent to those skilled in the art that it is not so limited, but is susceptible to various changes without departing from the scope of the invention. For example, the pipes may be provided with multiple optic fibers, electrical wires, and their associated lenses and contacts, respectively.

What is claimed is:

1. A section of pipe, comprising:

a cylindrical fiber composite pipe body formed from a plurality of wound fiber strands and having first and second axial ends;

a first end fitting mounted to the first axial end of the pipe body and having a first mating feature;

a second end fitting mounted to the second axial end of the pipe body and having a second mating feature for coupling with the first mating feature and ensuring proper rotational alignment with an abutting section of pipe;

a data transmission conduit in the pipe body for transmitting data to the abutting section of pipe; and wherein each end fitting is a flange with a flat face and a plurality of bolt holes that extend through the flange.

2. A section of pipe, comprising:

a cylindrical fiber composite pipe body formed from a plurality of wound fiber strands and having first and second axial ends;

a first end fitting mounted to the first axial end of the pipe body and having a first mating feature;

a second end fitting mounted to the second axial end of the pipe body and having a second mating feature for coupling with the first mating feature and ensuring proper rotational alignment with an abutting section of pipe;

a data transmission conduit in the pipe body for transmitting data to the abutting section of pipe; and wherein each end fitting is threaded and has a base with a flat face.

3. A section of pipe, comprising:

a cylindrical fiber composite pipe body formed from a plurality of wound fiber strands and having first and second axial ends;

a first end fitting mounted to the first axial end of the pipe body and having first mating feature;

a second end fitting mounted to the second axial end of the pipe body and having a second mating feature for coupling with the first mating feature and ensuring proper rotational alignment with an abutting section of pipe;

a data transmission conduit in the pipe body for transmitting data to the abutting section of pipe; and wherein the data transmission conduit extends through an entire length of the pipe body including each of the end fittings.

4. A section of pipe, comprising:

a cylindrical fiber composite pipe body formed from a plurality of wound fiber strands and having first and second axial ends;

a first end fitting mounted to the first axial end of the pipe body and having a first mating feature;

a second end fitting mounted to the second axial end of the pipe body and having a second mating feature for coupling with the first mating feature and ensuring proper rotational alignment with an abutting section of pipe;

a data transmission conduit in the pipe body for transmitting data to the abutting section of pipe; and wherein the data transmission conduit is located within a protective, insulating sheath that provides mechanical strength for the pipe body.

5. A section of pipe, comprising:

a cylindrical fiber composite pipe body formed from a plurality of wound strands embedded and cured in a resinous matrix, the pipe body having first and second axial ends;

a first end fitting mounted to the first axial end of the pipe body and having a first mating feature;

a second end fitting mounted to the second axial end of the pipe body and having a second mating feature for coupling with the first mating feature and ensuring proper rotational alignment with an abutting section of pipe, wherein the pipe body and the end fittings are axially aligned; wherein at least one of the strands in the pipe body is a data transmission conduit for transmitting data to the abutting section of pipe, wherein the data transmission conduit extends through an entire length of the pipe body including each of the end fittings; and a coupling at each end of the data transmission conduit that is capable of sending and receiving data transmissions via optical signals; and wherein the mating features also ensure proper alignment with a coupling located on the abutting section of pipe.

6. The pipe of claim 5 wherein each end fitting is a flange with a flat face and a plurality of bolt holes that extend through the flange.

7. The pipe of claim 5 wherein each end fitting is threaded and has a base with a flat face.

8. The pipe of claim 5 wherein the data transmission conduit is located within a protective, insulating sheath that provides mechanical strength for the pipe body.

9. A method of interconnecting sections of pipe, comprising the steps of:

(a) providing each pipe section with a pipe body, a first end fitting having a first mating feature, a second end fitting opposite the first end fitting and having a second mating feature, and a data transmission conduit located within the pipe body and extending through each end fitting;

(b) joining the first end fitting of one pipe section to the second end fitting of another pipe section;

(c) rotationally aligning the pipe sections via the mating features such that the data transmission conduits of the respective pipe sections are aligned; and (d) transmitting data through the data transmission conduits of the pipe sections.

10. The method of claim 9 wherein step (b) comprises axially abutting the pipe sections and bolting them together.

11. The method of claim 9 wherein step (b) comprises rotating the pipe sections to thread the pipe sections together.

12. The method of claim 9 wherein step (d) comprises transmitting electrical signals.

13. The method of claim 9 wherein step (d) comprises transmitting optical signals.

* * * * *